US008561972B2

(12) United States Patent
Neville

(10) Patent No.: US 8,561,972 B2
(45) Date of Patent: Oct. 22, 2013

(54) LOW PRESSURE GAS TRANSFER DEVICE

(75) Inventor: Mark Neville, Raynham, MA (US)

(73) Assignee: KLA Systems, Inc., Assonet, MA (US)

( * ) Notice: Subject to any disclaimer, the term of this patent is extended or adjusted under 35 U.S.C. 154(b) by 416 days.

(21) Appl. No.: 12/827,081

(22) Filed: Jun. 30, 2010

(65) Prior Publication Data

US 2012/0001351 A1 Jan. 5, 2012

(51) Int. Cl.
*B01F 3/04* (2006.01)

(52) U.S. Cl.
USPC ..... 261/76; 261/116; 239/427.5; 239/431

(58) Field of Classification Search
USPC ..... 261/28, 76, 116, DIG. 75; 239/427.3, 239/427.5, 428, 431, 434
See application file for complete search history.

(56) References Cited

U.S. PATENT DOCUMENTS

| | | | | |
|---|---|---|---|---|
| 1,526,179 | A * | 2/1925 | Parr et al. | 417/174 |
| 1,594,641 | A * | 8/1926 | Starr | 239/8 |
| 3,761,065 | A * | 9/1973 | Rich et al. | 261/76 |
| 4,395,202 | A * | 7/1983 | Tell | 417/169 |
| 4,690,764 | A * | 9/1987 | Okumura et al. | 210/629 |
| 4,761,077 | A * | 8/1988 | Werner | 366/165.1 |
| 4,834,343 | A * | 5/1989 | Boyes | 261/79.2 |
| 5,169,293 | A * | 12/1992 | Yamamoto | 417/179 |
| 5,386,941 | A * | 2/1995 | Haynes | 239/427.3 |
| 8,231,358 | B2 * | 7/2012 | Cho | 417/187 |
| 2012/0003707 | A1 | 1/2012 | Hickey et al. | |

OTHER PUBLICATIONS

Waste Water Treatment, Bayer Tower Biology with Bayer Slot Injector Aeration System Information Sheet, Sep. 2009.
Non-Final Office Action of U.S. Appl. No. 12/826,991, sent electronically on Aug. 17, 2012.
Response to Office Action mailed Aug. 17, 2012, dated Sep. 17, 2012.
KLa Systems "Technology Guide," 2001, updated 2009.
KLa Systems Brochure: "Jet Aeration Technology," 2003.
KLa Systems Brochure: "The Shape of Things to Come Slot Injector," 2005.

* cited by examiner

*Primary Examiner* — Charles Bushey
(74) *Attorney, Agent, or Firm* — Neal, Gerber & Eisenberg LLP

(57) ABSTRACT

Certain embodiments of the present technology present a low pressure gas transfer device for transferring gas into a liquid stream. The gas transfer device has a primary pipe branch with a gas injector, and a secondary pipe branch intersecting the primary pipe branch. A liquid stream passing through the secondary pipe branch mixes with the liquid stream passing through the primary pipe branch. The primary outlet port delivers a dispersion stream that is a mixture of gas-injected liquid passing through the primary pipe branch and the secondary liquid stream passing through the secondary pipe branch.

18 Claims, 4 Drawing Sheets

LOW PRESSURE GAS TRANSFER DEVICE

BACKGROUND OF THE INVENTION

The present technology generally relates to a gas transfer device. More specifically, the present technology relates to gas transfer devices having a plurality of inlets for lowering the gas pressure and/or lowering the liquid flow volume of the injector device.

A plurality of fields and endeavors practice converting a gas stream component by contacting the component with a conversion medium in a liquid phase. Devices are known for the dispersion of gas into a liquid medium include venturi injectors, slot injectors, jet injectors and other high pressure mixers. Such gas transfer devices have found widespread use in a variety of fields including those of wastewater treatment and fermentation.

Where a gas stream has a limited solubility, contact and conversion of the gas stream components may involve a gas stream that is well distributed as a fine dispersion within the liquid medium to increase the mass transfer between the gas phase and the conversion media in the liquid phase. This dispersion of gas into liquid streams is energy intensive and may require compression of the gas stream to provide the necessary energy to create a high dispersion of gas in liquid phase contacting mediums. Compression is a capitol and energy intensive step that can complicate and create unnecessary problems with the injection process. There thus exists a need for a gas transfer device that operates at a low pressure, as such a system can reduce the need for compression of the gas stream into the liquid medium.

BRIEF SUMMARY OF THE INVENTION

Certain embodiments of the present technology present a low pressure gas transfer device for transferring gas into a liquid stream. Certain embodiments of the present technology describe a fluid delivery system that uses the gas transfer device described herein.

The gas transfer device of the present technology has a primary pipe branch with a primary liquid inlet port for receiving a primary liquid stream and a primary liquid outlet port for ejecting a dispersion stream. The device also has a secondary pipe branch with at least one secondary liquid inlet port. The secondary liquid inlet port receives a secondary liquid stream. The primary pipe branch intersects the secondary pipe branch at an intersection region. In certain embodiments, the primary pipe branch may intersect the secondary pipe branch at a right angle, such that the two branches are perpendicular, or at an acute angle.

The device of the present technology also comprises a gas inlet port in fluid connection with the primary pipe branch, and a gas injector situated upstream from the primary liquid outlet port. The gas injector can be situated entirely or partially within the primary pipe branch, for example. In certain embodiments the gas injector has an outer mixing chamber extending from the injector. The outer mixing chamber can project into the intersection region and may extend through the entire intersection region and into the primary liquid outlet port, it may extend just up to the point where the primary liquid outlet port meets the secondary pipe branch, or it may extend only partially into the intersection region. The cross sectional area of the outer mixing chamber may remain constant or decrease in the direction of flow of the primary liquid stream. For example, the diameter of the outer mixing chamber may be larger at the point where the outer mixing chamber connects to the injector than at the outlet port of the outer mixing chamber. The gas injector can be, for example, a venturi-type eductor, a jet injector and a slot injector device. The dimensions of the pipe branches of the device can vary as desired. In certain embodiments, the primary pipe branch liquid inlet port diameter is about 15 cm, the primary pipe branch liquid outlet port diameter is about 10 cm, the secondary pipe branch diameter is about 15 cm and the gas inlet port diameter is about 5 cm. The secondary pipe branch can also have a liquid outlet port, and may have a second or more liquid inlet ports.

In operation, the gas injector injects gas drawn from the gas inlet port into the primary liquid stream. The secondary liquid stream passing through the secondary pipe branch mixes with the gas injected primary liquid stream. The secondary liquid stream can increase the flow velocity of dispersion stream at the primary liquid outlet port. In certain embodiments the flow rate of the dispersion line is usually in the range of 0.5-2.0 meters/second, preferably at least 1 meter/second.

BRIEF DESCRIPTION OF SEVERAL VIEWS OF THE DRAWINGS

FIG. 4(*b*) shows an outer mixing chamber 264*b* for a gas transfer device where the cross sectional area of the outer mixing chamber decreases in the direction of flow of the primary liquid stream.

DETAILED DESCRIPTION OF THE INVENTION

The present technology describes a gas transfer or a gas injection device. The gas transfer device is typically placed in line with a liquid conduit system, such as a tube or pipe, for example. The gas transfer device injects gas from an inlet port into a stream of liquid passing through the device. The gas transfer device creates a dispersion stream and promotes mixing of gas and liquid to disperse gas as bubbles into the liquid.

One operating parameter of the gas injector is the exit velocity of the gas-liquid dispersion at its outlet. Higher exit velocities on the outlet of the gas injector and dispersion conduit minimize the time for bubble coalescence before the dispersion stream gets to the fluid discharge point. Thus, increasing the exit velocity of a liquid stream can achieve more desirable dispersion results in the gas dispersion stream. Velocity of the dispersion stream downstream of the gas injector is usually in the range of 0.5-2.0 meters/second. Preferably the dispersion stream will have an average velocity of at least 1 meter/second between the gas injector outlet and the gas discharge point.

Figure 1:
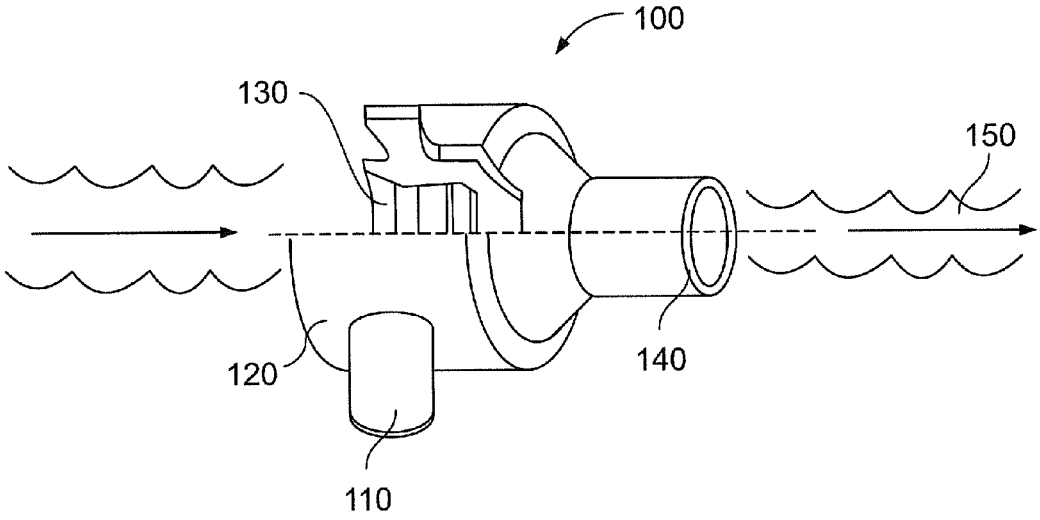
FIG. 1 PRIOR ART
FIG. 1 depicts an embodiment of a general gas injection device known in the art.

A typical gas injector device 100 known in the art is depicted in FIG. 1. FIG. 1 shows the typical internal arrangement of a gas injector 100 in more detail. The injector 100 has a gas inlet 110, a liquid inlet 130 a mixing zone 120 where the two streams meet and an outlet 140 that discharges the dispersion 150. A function of the gas injector is to provide a dispersion stream at the outlet 140 of the gas injector. Because the injector device 100 accommodates only one liquid stream, the velocity of the dispersion stream is dependent on the flow velocity of the stream into the device.

Figure 2:
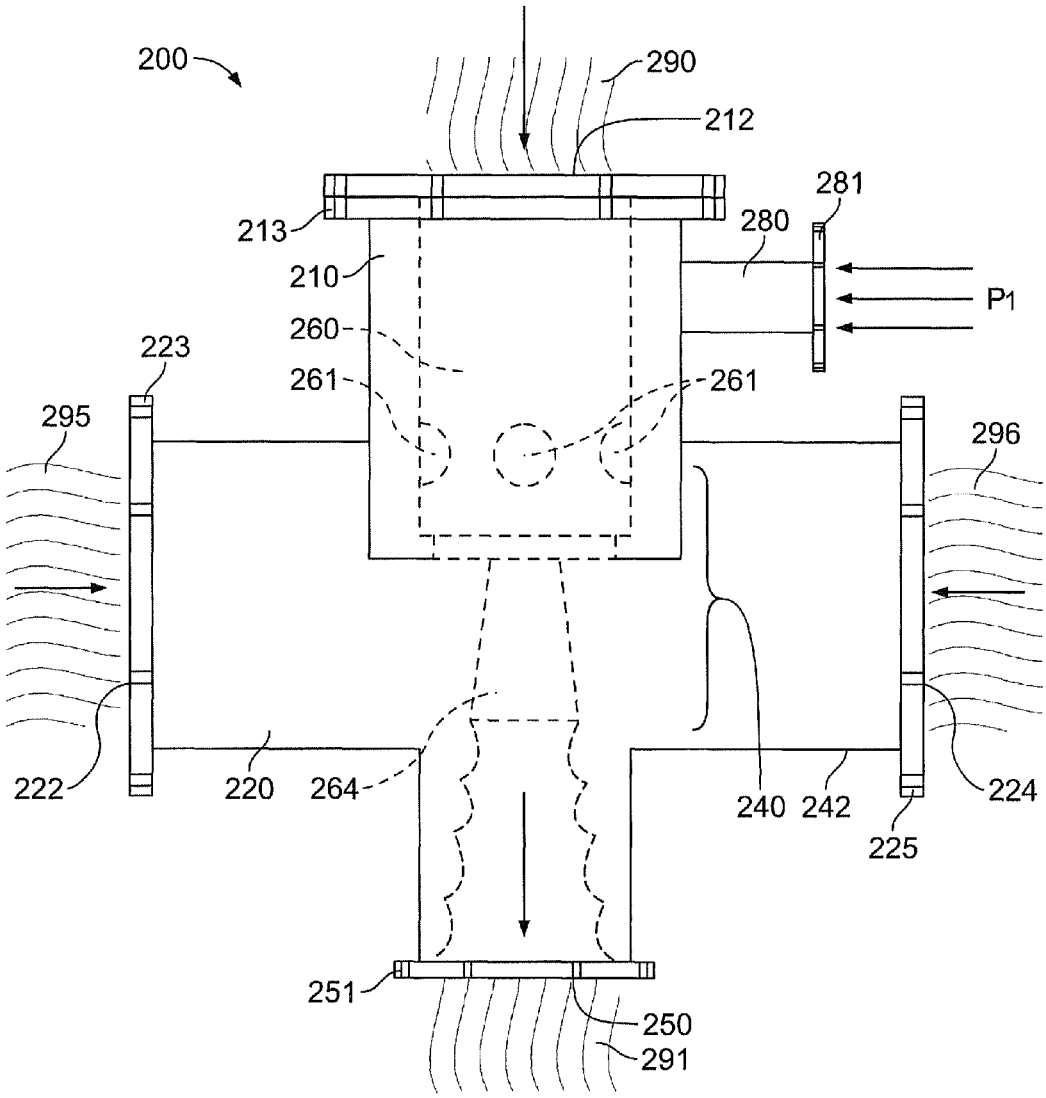
FIG. 2 depicts a side view of a gas transfer device in accordance with the present technology.

FIG. 2 depicts an embodiment of a gas transfer device 200 in accordance with the present technology. The device 200 has two additional pipe branches allowing for two additional liquid streams to combine with the flow from an outer mixing chamber 264 and thus the velocity of the dispersion stream can be increased.

The gas transfer device 200 is shaped similar to a cross comprising two intersecting pipe branches. The device 200 may be made of fiberglass reinforced plastic, for example. Alternatively, the device 200 may be made of other materials such as stainless steel, polypropylene, polyethylene, PVDF, or cast iron for example. The gas transfer device comprises a primary pipe branch 210 that intersects a secondary pipe branch 220 at an intersection region 240. Though the device is depicted in a configuration where a liquid stream 290 flows from the top to bottom of the Figure, the device may be oriented such that the primary pipe branch 210 is in a horizontal configuration and the secondary pipe branch 220 is vertical, for example. Additionally, in certain embodiments, the pipe branches may intersect at an acute angle, such that the two (or more) pipe branches are not perpendicular. The intersection region 240 can be a mixing zone, where the multiple liquid inlets meet and are channeled through an outlet, for example.

In FIG. 2, the device comprises three fluid inlets. A primary inlet port 212 is situated at the top of the primary pipe branch 210. The primary inlet port 212 can also be referred to as the top inlet port. Secondary ports 222 and 224 are situated at the ends of the secondary pipe branch 220. In certain embodiments, the left port 222 and right port 224 are fluid inlets each receiving at least one secondary liquid stream 295 (and/or 296). Alternatively, left port 222 may be a fluid inlet and the right port 224 a fluid outlet, where a single secondary liquid 295 stream passes through the secondary pipe branch 220. The flow through the device 200 may reverse, making the right port 224 a fluid inlet and the left port 222 a fluid outlet. In certain embodiments both the left port 222 and right port 224 may be outlet ports, depending on the situational circumstances, and the current state of the fluid system. Additionally, in certain embodiments the device 200 may comprise more than one secondary pipe branches, each having one or more inlet and/or outlet ports that intersect the device 200 at the intersection region 240.

A primary outlet port 250 is situated at the bottom of the device 200, through which a dispersion stream 291 exits the device 200. In certain embodiments, the diameter of the secondary pipe branch is 15 cm, the diameter of the primary pipe branch is 15 cm at the inlet 212, and the diameter of the primary outlet port 250 is 10 cm, for example. Other pipe diameters and configurations can be used for various devices, depending on the amount of liquid intended to pass through the device.

At the end of each pipe branch or port is a connection such as a flange, coupling, weld or other method of attachment (213, 223, 225 and 251) that allows the device to be connected to a fluid delivery system. The flanges can be the same size, or different sizes depending on the needs of the system. For example, FIG. 2 depicts the three flanges (213, 223 and 225) at the ports (212, 222 and 224, respectively) extend about 150 mm beyond the diameter of the pipe, and the flange 251 at the primary outlet port 250 extends about 100 mm beyond the diameter of the pipe. The pipe flanges are configured to lie flush against flanges of other pipes or conduits, allowing the device 200 to be connected into a fluid transfer system, for example. The flanges provide a mechanism whereby connectors such as adhesives, bolts and screws can be used to provide a liquid tight connection with the connected pipes or conduits.

An injector 260 is situated within the top pipe branch 210. In certain embodiments of the present technology, the injector 260 is a slot injector model number KSI supplied by $K_La$ Systems Inc. of Assonet, Mass., for example. The injector 260 can also be a venturi-type eductor, a jet injector, a slot injector device or an injector as depicted in FIG. 1, for example. A gas inlet port 280 in the primary pipe branch delivers air to the gas injector. The gas inlet port 280 has a flange 281 for connection to another pipe or line. The gas inlet flange 281 can be used to connect the gas inlet to another pipe, such as a gas delivery line, for example. The gas inlet flange 281 may extend about 50 mm beyond the diameter of the gas inlet port 280 and though other dimensions can be used. The injector 260 injects gas received from the gas inlet port 280 into the liquid stream 290 entering the device 200 through the primary inlet port 212. A pressure $P_1$ is exerted at the gas inlet port 280 to deliver gas into the liquid stream 290 in the form of bubbles. The gas can be injected, for example, through a series of holes 261 in the injector 260. The injector 260 also comprises an outer mixing chamber 264 for dispersing the liquid stream injected with gas 291 (the "gas dispersion stream"), through and out of the device 200.

In certain embodiments the outer mixing chamber 264 extends through the width of the secondary pipe branch 220, such that the outlet of the outer mixing chamber 264 is parallel with the downstream surface 242 of the secondary pipe branch 220. The outer mixing chamber may also extend into the primary outlet port 250. Alternatively, the outer mixing chamber may extend only partially into the intersecting region 240. The position of the outer mixing chamber 264 in the gas transfer device 200 can adjusted to improve blending of the primary and secondary streams before entering the primary outlet port 250. Further, various diameters, shapes and sizes of the pipe branches 220, 210 and 250 can be adjusted to achieve ideal blending as well.

Figure 3:
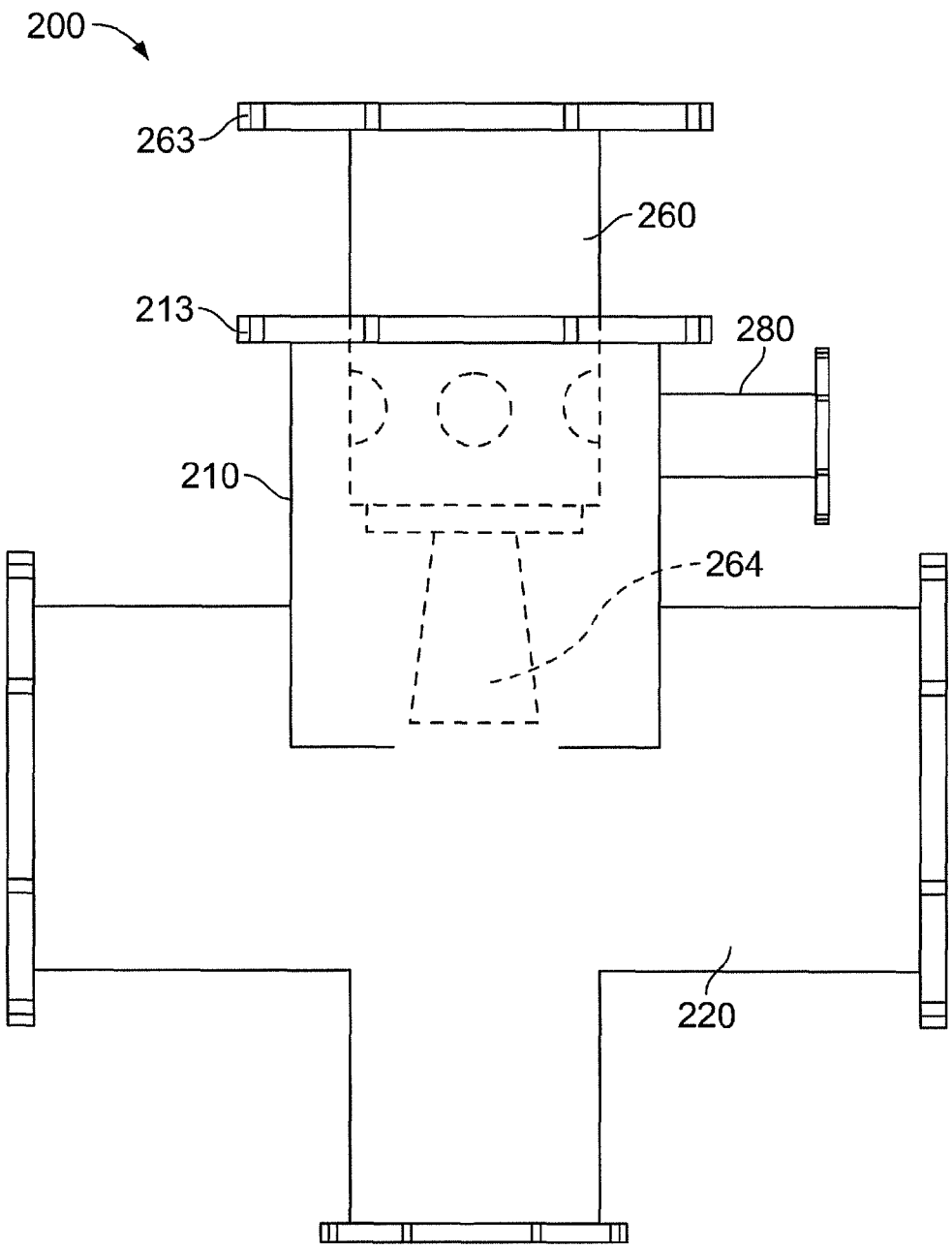
FIG. 3 depicts an assembly view of the gas transfer device of FIG. 2.
Figure 4A:
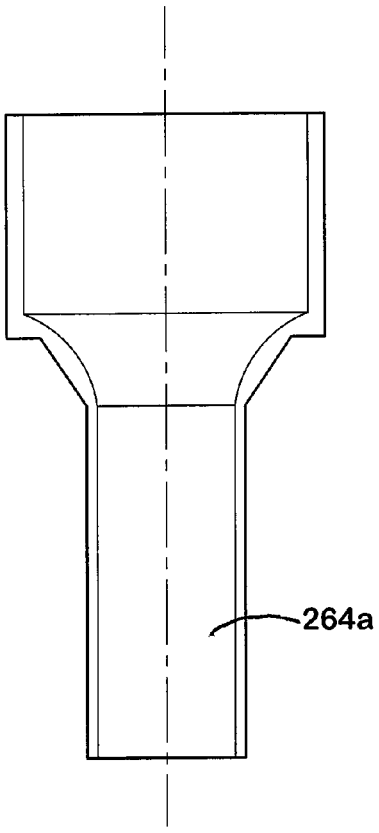
FIG. 4(*a*) shows an outer mixing chamber 264*a* for a gas transfer device where the cross sectional area of the outer mixing chamber remains the same in the direction of flow of the primary liquid stream.
Figure 4B:
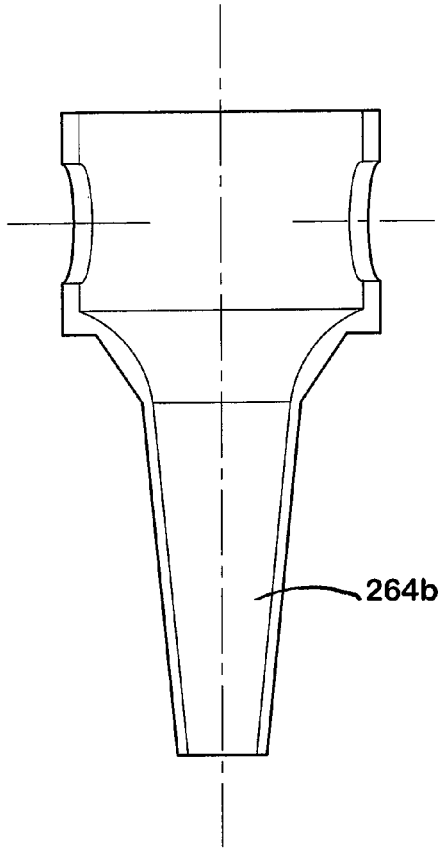

In certain embodiments, the injector is situated primarily, nearly entirely, or entirely within the primary pipe branch, as depicted in FIG. 2. FIG. 3 depicts an assembly view of the gas transfer device of the present technology. As shown, the injector is inserted into the primary pipe branch 210 through the top. The device can be held in place by a connection between the two flange surfaces 213 and 263, for example.

Referring again to FIG. 2, in operation, a primary liquid stream 290 enters the primary inlet port 212. The primary liquid stream may be pumped flow from a fluid transfer system, or it may be delivered by another means. A secondary liquid stream 295 or streams (e.g., liquid stream 296), which may be pumped from the same fluid transfer system, or another fluid transfer system, enters the device through the secondary pipe branch 220 at one of the side ports 222 or 224. The secondary liquid stream 295 mixes with the gas-injected liquid stream from the primary pipe branch in the intersection region 240 or the primary outlet port 250, depending on the location of the outer mixing chamber 264. The combined streams flow out of the device 200 as dispersion stream 291. At least a portion of the secondary liquid stream 295 may continue to flow out of the secondary pipe branch at a secondary outlet port, such as port 224, for example; however, where both ports 222 and 224 are fluid inlet ports, both secondary liquid streams 295 and 296 combine with the gas dispersion stream 291 to flow out of the device 290. In certain embodiments, port 224 may also serve as a secondary inlet port providing for a second secondary liquid stream to mix with the primary liquid stream form the dispersion stream 291. In additional embodiments, further secondary pipe branches and inlets can be added to the device to provide additional liquid streams. The increased volume of the dispersion stream 291 created by the mixture of the secondary streams 295 and 296 creates a faster flow velocity of the dispersion stream 291 out of the device 200.

The secondary liquid streams 295 and 296 can increase the velocity of the exiting liquid stream 291 that has been injected with gas. The increased flow velocity of the gas dispersion 291 reduces the pressure level $P_1$ necessary to inject gas into the liquid and provides a uniform dispersion of gas bubbles in the gas dispersion stream 291.

The present technology has now been described in such full, clear, concise and exact terms as to enable any person skilled in the art to which it pertains, to practice the same. It is to be understood that the foregoing describes preferred embodiments and examples of the present technology and that modifications may be made therein without departing from the spirit or scope of the invention as set forth in the claims. Moreover, while particular elements, embodiments and applications of the present technology have been shown and described, it will be understood, of course, that the present technology is not limited thereto since modifications can be made by those skilled in the art without departing from the scope of the present disclosure, particularly in light of the foregoing teachings and appended claims. Moreover, it is also understood that the embodiments shown in the drawings, if any, and as described above are merely for illustrative purposes and not intended to limit the scope of the invention, which is defined by the following claims as interpreted according to the principles of patent law, including the Doctrine of Equivalents. Further, all references cited herein are incorporated in their entirety.

The invention claimed is:

1. A low pressure gas transfer device for transferring gas into a liquid stream, the gas transfer device comprising:

a. a primary pipe branch having a primary liquid inlet port for receiving a primary liquid stream and a primary liquid outlet port for ejecting a dispersion stream;

b. a secondary pipe branch having at least one secondary liquid inlet port for receiving a secondary liquid stream; the primary pipe branch intersecting the secondary pipe branch at an intersection region;

c. a gas inlet port in fluid connection with the primary pipe branch; and d. a gas injector situated upstream from the primary liquid outlet port;

wherein the gas injector injects gas drawn from the gas inlet port into the primary liquid stream and wherein the secondary liquid stream passing through the secondary pipe branch mixes with the gas injected primary liquid stream, and the gas injector has an outer mixing chamber projecting from the injector into the intersection region.

2. The gas transfer device of claim 1, wherein the outer mixing chamber extends into the primary liquid outlet port.

3. The gas transfer device of claim 1, wherein the outer mixing chamber extends up to the intersection of the secondary pipe branch and the primary liquid outlet port.

4. The gas transfer device of claim 2, wherein the outer mixing chamber extends up to the location where the primary liquid outlet port intersects the secondary pipe branch.

5. The gas transfer device of claim 1, wherein the cross sectional area of the outer mixing chamber decreases or remains the same in the direction of flow of the primary liquid stream.

6. The gas transfer device of claim 1, wherein the gas injector is at least partially within the primary pipe branch.

7. The gas transfer device of claim 1, wherein the secondary liquid stream increases the flow velocity of dispersion stream at the primary liquid outlet port.

8. The gas transfer device of claim 1, wherein the primary pipe branch liquid inlet port has a diameter of about 15 cm.

9. The gas transfer device of claim 1, wherein the primary pipe branch liquid outlet port has a diameter of at least about 10 cm.

10. The gas transfer device of claim 1, wherein the secondary pipe branch has a diameter of at least about 15 cm.

11. The gas transfer device of claim 1, wherein the gas inlet port has a diameter of at least about 5 cm.

12. The gas transfer device of claim 1, wherein the gas injector comprises at least one of a venturi-type eductor, a jet injector and a slot injector device.

13. The gas transfer device of claim 1, wherein the primary pipe branch and the secondary pipe branch intersect at a right or an acute angle.

14. The gas transfer device of claim 1, wherein the secondary pipe branch has a liquid outlet port.

15. The gas transfer device of claim 1, wherein the secondary pipe branch has a second liquid inlet port.

16. The gas transfer device of claim 1, wherein the velocity of the dispersion stream downstream of the gas injector is between 0.5 and 2 m/second.

17. The gas transfer device of claim 1, wherein the velocity of the dispersion stream downstream of the gas injector is greater than 1 m/sec.

18. A fluid delivery system comprising a. a primary liquid delivery line;

b. a gas delivery line;

c. one or more secondary liquid delivery lines; and d. a low pressure gas transfer device for transferring gas into a liquid stream, the gas transfer device comprising:

i. a primary pipe branch having a liquid inlet port for receiving a primary liquid stream from the primary liquid delivery line, a mixing chamber and an outlet port for ejecting a dispersion stream;

ii. a secondary pipe branch having at least one secondary liquid inlet port for receiving a secondary liquid stream from the secondary liquid delivery line; the primary pipe branch intersecting the secondary pipe branch at an intersection region;

iii. a gas inlet port in fluid connection with the primary pipe branch for receiving a gas stream from the gas delivery line; and iv. a gas injector situated upstream from the primary liquid outlet port;

wherein the gas injector injects gas drawn from the gas inlet port into the primary liquid stream and wherein the secondary liquid stream passing through the secondary pipe branch mixes with the gas injected primary liquid stream, and the injector has an outer mixing chamber projecting from the injector into the intersection region.

* * * * *

UNITED STATES PATENT AND TRADEMARK OFFICE

CERTIFICATE OF CORRECTION

PATENT NO. : 8,561,972 B2
APPLICATION NO. : 12/827081
DATED : October 22, 2013
INVENTOR(S) : Mark Neville It is certified that error appears in the above-identified patent and that said Letters Patent is hereby corrected as shown below:

In the Claims

Column 6, line 57 in Claim 18, please insert the word --gas-- before the word "injector"

Signed and Sealed this
Twenty-first Day of October, 2014

Michelle K. Lee

Michelle K. Lee
*Deputy Director of the United States Patent and Trademark Office*